US005323085A

United States Patent [19]

Genz

[11] Patent Number: 5,323,085

[45] Date of Patent: Jun. 21, 1994

[54] METAL HALIDE HIGH-PRESSURE DISCHARGE LAMP WITH A FILL CONTAINING HAFNIUM AND/OR ZIRCONIUM

[75] Inventor: Andreas Genz, Berlin, Fed. Rep. of Germany

[73] Assignee: Patent-Treuhand-Gesellschaft für elektrische Glühlampen m.b.H., Munich, Fed. Rep. of Germany

[21] Appl. No.: 805,858

[22] Filed: Dec. 10, 1991

[30] Foreign Application Priority Data

Dec. 20, 1990 [DE] Fed. Rep. of Germany ..... 4040858

[51] Int. Cl.[5] ..... H01J 61/20

[52] U.S. Cl. ..... 313/570; 313/640; 313/641

[58] Field of Search ..... 313/570, 638, 640, 641, 313/642

[56] References Cited

U.S. PATENT DOCUMENTS 3,521,110 7/1970 Johnson ..... 313/642
3,575,630 4/1971 Edris .
5,138,227 8/1992 Heider et al. ..... 313/640

FOREIGN PATENT DOCUMENTS 2130255 3/1972 France .

OTHER PUBLICATIONS

Patent Abstracts of Japan, vol. 9, No. 19, Jan. 1985 of JP-A-59 167 948.
Patent Abstracts of Japan, vol. 9, No. 19, Jan. 1985 of JP-A-59 167 949.
Database WPIL, Section Ch, Week 8112, Derwent Publications, Ltd., London, GB, AN 81-20610D of JP-A-49 108 864.
Patent Abstracts of Japan, vol. 6, No. 91 (E-109) May 28, 1982 of JP-A-57 025 665, Feb. 1982.
Patent Abstracts of Japan, vol. 1, No. 89 (M-031) Aug. 18, 1977, of JP-A-52 031 583 (Toshiba Corp), Mar. 1977.

*Primary Examiner*—Sandra L. O'Shea
*Attorney, Agent, or Firm*—Frishauf, Holtz, Goodman & Woodward

[57] ABSTRACT

To generate light output from a metal halide discharge lamp having a fill which includes mercury, at least one noble gas, cesium and a metal halide, such that the color temperature will be between 4000 and 9000 K., and the color rendering index Ra is greater than 90, while, for the red spectral range, the color rendering index $R_9$ is at least 50, the metal of the metal halides comprises hafnium, preferably present between 0.02 to 6 mg, or zirconium, preferably present between 0.01 to 4 mg, each per milliliter of volume of the discharge vessel (2, 14, 28). Both hafnium and zirconium may also be added.

11 Claims, 3 Drawing Sheets

METAL HALIDE HIGH-PRESSURE DISCHARGE LAMP WITH A FILL CONTAINING HAFNIUM AND/OR ZIRCONIUM

REFERENCE TO RELATED PATENT AND DISCLOSURE

U.S. Pat. No. 3,654,506 British 1,376,509.

Reference to related application, the disclosure of which is hereby incorporated by reference, assigned to the assignee of the present application: U.S. Ser. No. 07/732,061, filed Jul. 18, 1991, Genz and Kiele now U.S. Pat. No. 5,264,760.

FIELD OF THE INVENTION

The present invention relates to a metal halide high-pressure discharge lamp, and more particularly to such a lamp which has a fill of such a nature that, in operation of the lamp, light will be emitted which has a color temperature between 4000 and 9000 K., a color rendering index Ra which is greater than 90 and, for the red spectral range, a color rendering index $R_9$ of at least 50.

BACKGROUND

High-pressure metal halide discharge lamps of the type to which the present invention relates are used frequently in illumination systems for theater stages and for film and television studios. The light should have a color temperature of between 4000 and 9000 K. and excellent color rendition in all the color temperature ranges. Such lamps also are used in projection technology and in spot illumination, and especially where special light color illumination effects are desired.

The referenced U.S. Pat. No. 3,654,506 and British 1,376,509 describe mercury high-pressure discharge lamps which have halide additives. The halides used are dysprosium halide and/or holmium halide and/or thulium halide. These lamps provide light which has a spectral composition approximating daylight, with a color temperature of about 6000 K. The color rendition index Ra, however, does not have optimal values. Especially, the color rendition index $R_9$ for red spectral ranges has at the most a value of the stage 3 of about 40. This is also true for most of the high-pressure discharge lamps of other types or fills on the market, also used for the purposes of the lamp of the present invention. It is of importance to provide for appropriate and correct illumination which correctly reproduces red hues, and particularly skin color. Such correct rendition of red hues is of particular importance when the light source is used for theater stages, film or television studios.

THE INVENTION

It is an object to provide a metal halid high-pressure discharge lamp which has a radiation output of color temperature between 4000 and 9000 K. and, further, has an overall color rendition index Ra of more than 90, and especially a color rendition index $R_9$ in the red spectral range having a value of 50 and more.

Briefly, and in order to obtain this particular spectral light output in operation of the lamp, the metal halides comprise a hafnium halide or a zirconium halide or a mixture of hafnium and zirconium halides.

Using hafnium and/or zirconium as the metal for the metal halide fill can improve the color rendition index. Depending on the type of lamp, red color rendition index $R_9$ values between 50 and 98 can be obtained. The overall color rendition index Ra always will have a value of above 90.

It has been found, surprisingly that, upon operation of the lamps with a dimmer, no blackening of the lamp bulb will result. The color rendition index does not collapse as the power is reduced, so that good color rendition values can be obtained even when operating the lamp at reduced levels. Use of hafnium and/or zirconium permits an increase in the arc voltage which permits, with equal quantity of mercury, to decrease the electrode spacing to thereby obtain higher light densities. It has further been found that lamps having a hafnium and/or zirconium fill are less subject to devitrification.

Optimum results were obtained when the discharge vessel contains hafnium in a quantity of between 0.02 to 6 mg per milliliter of volume of the discharge vessel. When using zirconium, the fill, per milliliter (ml) of the discharge vessel volume, should be about 0.01 to 4 mg of the zirconium metal. The halogen used is, preferably, iodine or bromine, with a mol relationship between 0.2 and 5. Preferably, the discharge vessel should also contain cesium, present preferably in a quantity of about 4 mg per milliliter of volume of the vessel.

A desired color temperature between 4000 and 9000 K. can be obtained by adding to the fill in the discharge vessel one or more rare-earth metals such as dysprosium or gadolinium, and nickel and/or cobalt.

Other additives were investigated, but no improvements with respect to the object of the invention have been found.

DRAWINGS

DETAILED DESCRIPTION

Figure 1:
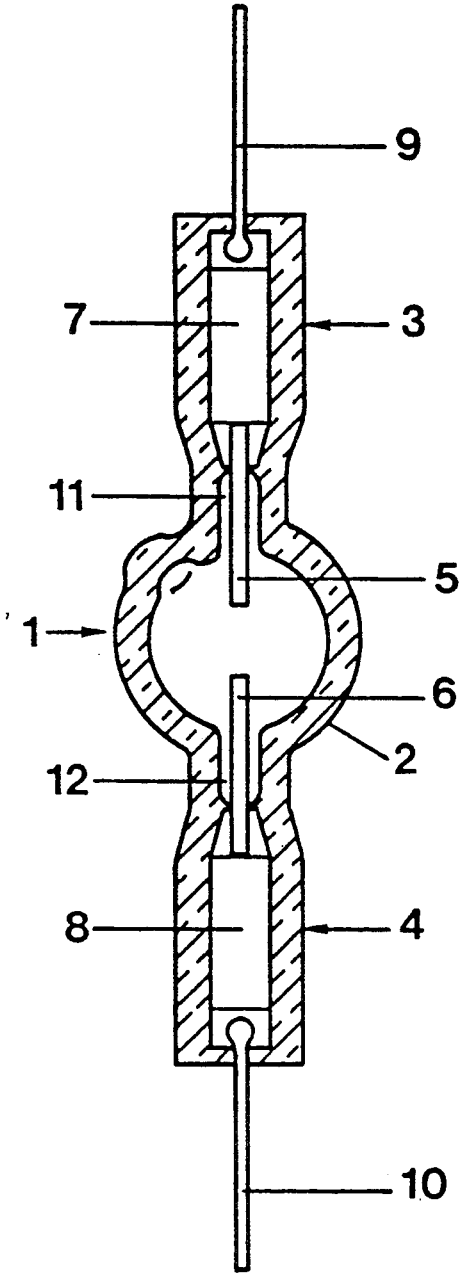
FIG. 1 is a highly schematic vertical side view of a 400 W metal halide high-pressure discharge lamp in accordance with the present invention.

The lamp of FIG. 1 is rated for 400 W. Lamp 1 is intended to be used with a reflector or other optical system (not shown). It includes a discharge vessel 2 of quartz glass of approximately spherical shape. At diametrically opposite sides, necks 3, 4 are formed in which pin or rod-like tungsten electrodes 5, 6 are sealed by means of sealing foils 7, 8 of molybdenum. The distal ends of sealing foils 7, 8 are welded to current supply leads 9, 10. Free spaces 11, 12 are formed in the transition between the electrodes 5, 6 and the glass jacket of the necks 3, 4. These spaces 11, 12 permit tungsten which is removed from the electrodes to be collected, as well as other condensed contaminants arising within the interior of the lamp 1, so that blackening of the portions of the discharge vessel 2 which are primarily used for light radiation is prevented.

Table 1 illustrates light-technical data of the lamp for two different fills, one including hafnium and one including zirconium.

TABLE 1

| | Fill 1 | Fill 2 |
|---|---|---|
| $I_2$ | 1.70 mg | 1.10 mg |
| $Br_2$ | 0.84 mg | 1.28 mg |
| Cs | 1.10 mg | 1.10 mg |

TABLE 1-continued

| | Fill 1 | Fill 2 |
|---|---|---|
| Hf | 1.80 mg | — |
| Zr | — | 0.48 mg |
| Hg | 11 mg | 11 mg |
| Ar | 300 mbar | 300 mbar |
| rated power | 400 W | 400 W |
| volume of vessel 2 | 0.8 ml | 0.8 ml |
| electrode spacing | 4.2 mm | 4.2 mm |
| arc voltage | 60 V | 60 V |
| color temperature | 5200 K.° | 6200 K.° |
| light output | 70 lm/W | 68 lm/W |
| color rendition index Ra | 95 | 97 |
| red range color rend. index $R_9$ | 90 | 94 |
| rated lifetime | 300 h | 300 h |
| specific Hf | 2.25 mg/ml | |
| specific Zr | — | 0.6 mg/ml |

Figure 2:
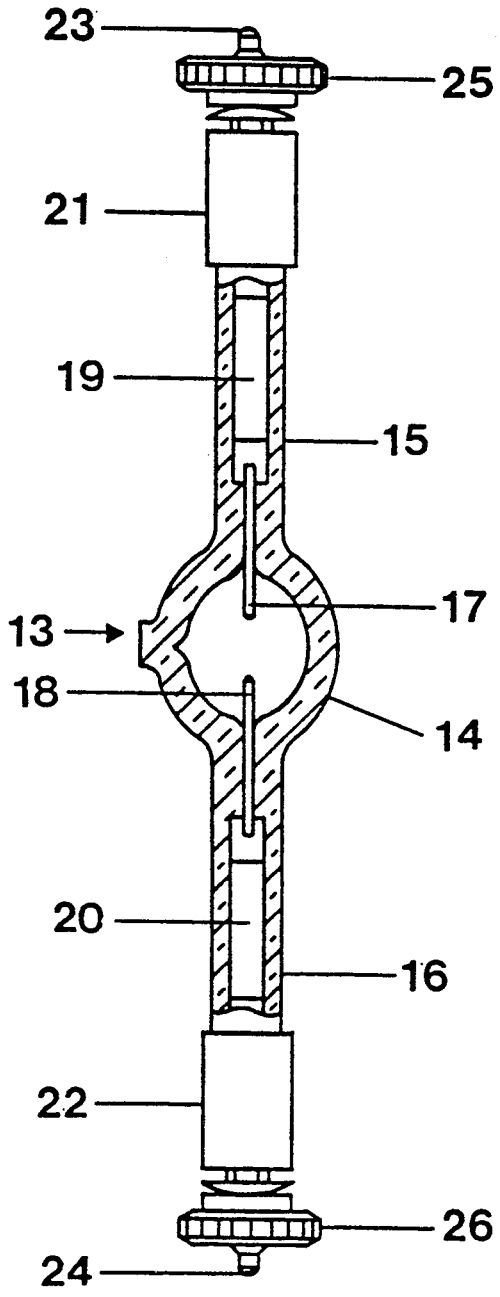
FIG. 2 is a schematic vertical view, partly in section, of a 575 W metal halid high-pressure discharge lamp.

FIG. 2 illustrates a double-ended, double-based metal halide high-pressure discharge lamp 13, having a rated power of 575 W. The discharge vessel 14 is made of quartz glass and is essentially spherical. Necks 15, 16 are formed on diametrically opposite sides, in which pin electrodes 17, 18 of tungsten are retained. Molybdenum sealing foils 19, 20 connect the electrodes 17, 18 to electrical connection bases of the type SFc 10-4. The base sleeves 21, 22 are fitted on the free ends of the respective necks 15, 16. The pin electrodes and molybdenum foils 19, 20 are gas-tightly melt-sealed in the necks. Threaded connecting pins 23, 24 are welded to the base sleeves 21, 22, retaining a knurled connecting knob 25, 26, each. The electrical connection to a supply circuit or, respectively, to a ballast or starter or accessory is provided by connecting cables, not shown, which are clamped between the knobs 25, 26 and the base sleeves 21, 22, respectively.

Electrical, fill and light technical data of the lamp 13 of FIG. 2 for two different fills are shown in Table 2.

TABLE 2

| | Fill 3 | Fill 4 |
|---|---|---|
| $I_2$ | 0.90 mg | 0.90 mg |
| $Br_2$ | 0.60 mg | 0.60 mg |
| Cs | 0.30 mg | 0.30 mg |
| Dy | 0.40 mg | 0.40 mg |
| Hf | 0.40 mg | — |
| Zr | — | 0.20 mg |
| Co | 0.05 mg | 0.07 mg |
| Hg | 42 mg | 46 mg |
| Ar | 400 mbar | 400 mbar |
| rated power | 575 W | 575 W |
| volume of vessel 2 | 2.60 ml | 2.60 ml |
| electrode spacing | 6 mm | 6 mm |
| arc voltage | 100 V | 100 V |
| color temperature | 5600 K.° | 5600 K.° |
| light output | 81 lm/W | 81 lm/W |
| color rendition index Ra | 94 | 95 |
| red range color rend. index $R_9$ | 65 | 75 |
| rated lifetime | 750 h | 750 h |
| specific Hf | 0.15 mg/ml | — |
| specific Zr | — | 0.078 mg/ml |
| specific Co | 0.019 mg/ml | 0.027 mg/ml |
| specific Dy | 0.15 mg/ml | 0.15 mg/ml |

Figure 3:
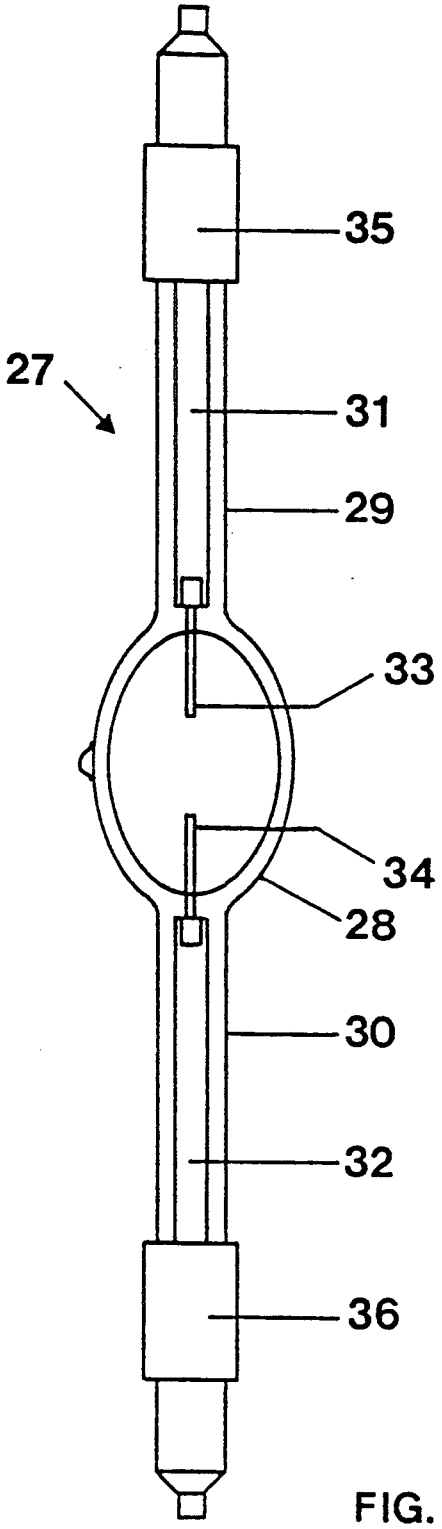
FIG. 3 is a side view of a 4000 W metal halide discharge lamp.

FIG. 3 illustrates a metal halide high-pressure discharge lamp 27 having a rated power of 4000 W. The discharge vessel 28 is made of quartz glass and is of ellipsoidal shape. Necks 29, 30 of quartz glass are melt-sealed to the ellipsoidal discharge vessel 28. A molybdenum sealing foil 31, 32 is melt-sealed in the necks 29, 30. The proximal ends of the foils 31, 32 are connected to pin or rod electrodes 33, 34 of tungsten. The distal ends of the sealing foils 31, 32 are electrically connected to bases 35, 36 of the type SFa 21-12, which are fitted over the free end of the necks 29, 30 and there are connected by cement or the like.

Table 3 illustrates three different fills of the discharge vessel of the lamp, one including hafnium, the other zirconium, and the third hafnium and zirconium, as well as light technical data.

TABLE 3

| | Fill 5 | Fill 6 | Fill 7 |
|---|---|---|---|
| $I_2$ | 1.30 mg | 1.30 mg | 1.30 mg |
| $Br_2$ | 2.30 mg | 2.30 mg | 2.30 mg |
| Cs | 1.20 mg | 1.20 mg | 1.20 mg |
| Dy | 0.95 mg | 1.10 mg | 1.00 mg |
| Gd | 0.55 mg | 0.40 mg | 0.50 mg |
| Hf | 0.27 mg | — | 0.15 mg |
| Zr | — | 0.14 mg | 0.04 mg |
| Hg | 235 mg | 220 mg | 230 mg |
| Ar | 400 mbar | 400 mbar | 400 mbar |
| rated power | 4000 W | 4000 W | 4000 W |
| volume of vessel 2 | 24.5 ml | 24.5 ml | 24.5 ml |
| electrode spacing | 20 mm | 20 mm | 20 mm |
| arc voltage | 200 V | 200 V | 200 V |
| color temperature | 6000 K.° | 6000 K.° | 6000 K.° |
| light output | 102 lm/W | 102 lm/W | 102 lm/W |
| color rendition index Ra | 96 | 98 | 97 |
| red range color rend. index $R_9$ | 92 | 95 | 93 |
| rated lifetime | 500 h | 500 h | 500 h |
| specific Hf | 0.011 mg/ml | — | 0.006 mg/ml |
| specific Zr | — | 0.006 mg/ml | 0.0016 mg/ml |
| specific Hf and Zr | — | — | 0.0076 mg/ml |
| specific Dy | 0.039 mg/ml | 0.045 mg/ml | 0.040 mg/ml |
| specific Gd | 0.022 mg/ml | 0.016 mg/ml | 0.020 mg/ml |
| specific Gd and Dy | 0.062 mg/ml | 0.062 mg/ml | 0.061 mg/ml |

Various changes and modifications may be made within the scope of the inventive concept.

The tables show that the fill, in general, includes mercury and at least one noble gas, cesium, and a metal halide.

I claim:

1. A metal halide high-pressure discharge lamp (1, 13, 27) having a discharge vessel (2, 14, 28), of high temperature resistant, light-transmissive material;

two electrodes (5, 6; 17, 18; 33, 34) within the discharge vessel;

a fill within said discharge vessel; and means for generating, in operation of the lamp, light having a color temperature between 4000 and 9000 K., a color rendering index Ra greater than 90 and, for the red spectral range, a color rendering index $R_9$ of at least 50, wherein said means is characterized in that said fill consists essentially of at least one noble gas, mercury and cesium and, in a quantity sufficient to affect the color rendering index (Ra) and the red spectral range index ($R_9$), a metal halide; and wherein the metal of said metal halide consists essentially of at least one metal of the group consisting of: hafnium and zirconium.

2. The lamp of claim 1, wherein the metal of said metal halides is hafnium.

3. The lamp of claim 2, wherein the hafnium is present in the discharge vessel (2, 14, 28) in a quantity of between 0.006 to 6 mg per milliliter of vessel volume.

4. The lamp of claim 1, wherein the metal of said metal halides is zirconium.

5. The lamp of claim 4, wherein the zirconium is present in the discharge vessel (2, 14, 28) in a quantity of between 0.006 to 4 mg per milliliter of vessel volume.

6. The lamp of claim 1, wherein the halogen of the halides consists essentially of at least one of: iodine and bromine in a mol relationship of between 0.2 and 5.

7. The lamp of claim 1, wherein the cesium in the fill is present in a quantity of up to 4 mg per ml of the volume of the discharge vessel (2, 14, 28).

8. The lamp of claim 1, wherein the metals of the metal halide comprise both hafnium and zirconium.

9. The lamp of claim 8, wherein the hafnium and zirconium are present in a combined amount of about 0.008 mg/ml of the volume of the discharge vessel (28).

10. A metal halide high-pressure discharge lamp (1, 13, 27) having a discharge vessel (2, 14, 28), of high temperature resistant, light-transmissive material;

two electrodes (5, 6; 17, 18; 33, 34) within the discharge vessel;

a fill within said discharge vessel; and means for generating, in operation of the lamp, light having a color temperature between 4000 and 9000 K., a color rendering index Ra greater than 90 and, for the red spectral range, a color rendering index $R_9$ of at least 50, wherein said means is characterized in that said fill consists essentially of at least one noble gas, mercury and cesium and at least one of: dysprosium, gadolinium and cobalt, said dysprosium being present, with respect to volume of the discharge vessel (14, 28), in a quantity of between about 0.039 to 0.15 mg/ml, said gadolinium in a quantity of about 0.02 mg/ml, and said cobalt in a quantity of between about 0.019 to 0.027 mg/ml;

and a metal halide, wherein the metal of said metal halide consists essentially of at least one of: hafnium and zirconium, said metal halide being present in the discharge vessel in a quantity sufficient to affect the color rendering index (Ra) and the red spectral range index ($R_9$).

11. The lamp of claim 10, wherein said fill includes both dysprosium and gadolinium present in a quantity of together about 0.06 mg/ml.

* * * * *